US006564693B2

(12) United States Patent
Daniel

(10) Patent No.: US 6,564,693 B2
(45) Date of Patent: May 20, 2003

(54) AXIAL PISTON PUMP OF THE TYPE HAVING INTERSECTING AXES

(75) Inventor: Bucheton Daniel, Fleury Merogis (FR)

(73) Assignee: Messier-Bugatti, Velizy Villacoublay (FR)

( * ) Notice: Subject to any disclaimer, the term of this patent is extended or adjusted under 35 U.S.C. 154(b) by 20 days.

(21) Appl. No.: 09/883,280

(22) Filed: Jun. 19, 2001

(65) Prior Publication Data

US 2002/0000159 A1 Jan. 3, 2002

(30) Foreign Application Priority Data

Jun. 30, 2000 (FR) ..... 00 08482

(51) Int. Cl.[7] ..... F01B 13/04
(52) U.S. Cl. ..... 91/503; 92/57
(58) Field of Search ..... 91/503, 499; 92/57, 92/71; 74/60

(56) References Cited

U.S. PATENT DOCUMENTS 2,177,008 A * 10/1939 Snader et al. ..... 91/499
4,941,395 A * 7/1990 Reynolds et al. ..... 92/57

FOREIGN PATENT DOCUMENTS

| | | |
|---|---|---|
| FR | 1261358 | 11/1961 |
| FR | 1456563 | 11/1967 |
| NL | 248888 | 10/1964 |

* cited by examiner

*Primary Examiner*—Edward K. Look
*Assistant Examiner*—Michael Leslie
(74) *Attorney, Agent, or Firm*—Sughrue Mion, PLLC

(57) ABSTRACT

The invention relates to a hydraulic pump having axial pistons, the pump being of the type having intersecting axes, and comprising a rotary rotor with a central axis co-operating with an associated distribution seat via a bearing surface that is substantially perpendicular to said axis, said rotor presenting a plurality of axial bores slidably receiving corresponding pistons. According to the invention, a driver separate from the rotor is provided to rotate about an axis of rotation that essentially coincides with said central axis, said driver serving firstly to center and rotate the rotor about said axis of rotation, and secondly to apply resilient thrust to press the bearing surface of the rotor against the distribution seat.

13 Claims, 2 Drawing Sheets

AXIAL PISTON PUMP OF THE TYPE HAVING INTERSECTING AXES

The present invention relates to the field of hydraulic pumps, and more particularly to axial piston pumps of the type having intersecting axes.

BACKGROUND OF THE INVENTION

In general, axial piston pumps in common use comprise a body containing a rotor mounted to rotate about its central axis and presenting a series of axial bores each slidably receiving a piston having one end constrained to remain substantially in a fixed plane that is not perpendicular to the axis of the rotor, thereby causing the piston to perform reciprocating motion in the bores while said rotor is rotating.

The bores and their pistons thus define variable-volume cylinders in communication with suction and delivery ports of the pump via a distribution seat that is mounted stationary in the pump body and that co-operates with the axial bearing face of the rotor, through which the axial bores open out. This distribution seat presents two kidney-shaped openings that are diametrically opposite and connected respectively to the suction port and to the delivery port.

Document FR-A-1 261 358 thus describes a pump having a rotor but not of the intersecting axis type. The rotor of that pump comprises two coaxial bodies that are rigidly secured to each other by means of fixing bolts and centering pins. The spring causing the rotor to bear against the distribution seat is interposed between a shoulder of the bottom body and the central cap of a rotating and oscillating cover, itself interposed between a central ball and hemispherical bearing surfaces formed on the axial pistons. Such an arrangement gives rise to high levels of friction that prevent high speeds of rotation.

Document FR-A-1 456 563 describes a pump in which the rotor is urged against the distribution seat by a resilient washer having a conical bearing surface bearing against a corresponding shoulder provided on the support for the distribution seat, so friction is high. The rotor is additionally centered by means of a central tube secured to the support of the distribution seat, so the only function of the driver is to rotate the rotor without being involved in centering the rotor or pressing said rotor against the distribution seat. The structure of such a pump is extremely complex, and implies high levels of friction that put a limit on operating speeds.

Document NL-A-248 888 illustrates a pump having intersecting axes in which the rotor is rotated by a driver screwed to the pump, and centered on a fixed axis. Thrust against the distribution seat is provided by Belleville washers bearing against a ring mounted on a central shaft secured to the support for the distribution seat. In that case also, the driver serves only to rotate the rotor.

Although it is now possible to obtain bearing faces with a very high degree of planeness, machining tolerances, and in particular concerning the perpendicularity of the bearing surface to the axis of rotation of the rotor, mean that deformation in operation makes it impossible to guarantee that the rotor bears continuously over its entire bearing face against the distribution seat.

Furthermore, in order to prevent the end of a piston sliding against the swashplate defining the fixed plane, a conventional improvement for pumps of this type consists in causing the swashplate to rotate with the rotor about an axis normal to the fixed plane and intersecting the axis of the rotor, using a constant speed coupling, e.g. meshing bevel gears. Under such circumstances, a link is advantageously provided between each axial piston and the swashplate, with the link having a ball-and-socket joint at both ends. This eliminates all sliding friction between the moving parts, other than sliding on the piston in its bore.

Still in the context of this improvement, the rotor is urged axially against the distribution seat in conventional manner by means of a spring bearing against the central zone of the swashplate, e.g. via a central ball secured to the swashplate, and urging the rotor against the distribution seat. The spring is thus installed between two parts that move relative to each other, thereby giving rise to sliding friction between the spring and at least one of those parts, subjecting them to wear and causing particles to be given off that pollute the inside of the pump.

In addition, the force of the spring is additional to the force of the links forcing the pistons into the bores in the rotor, giving rise to a high level of force on the swashplate, and that can overload the bearings concerned.

OBJECTS AND SUMMARY OF THE INVENTION

An object of the invention is to mitigate the above drawbacks by proposing an axial piston hydraulic pump of the intersecting axis type which does not have the above-mentioned drawbacks and limitations.

This problem is solved by a hydraulic pump having axial pistons, the pump being of the type having intersecting axes, and comprising a rotary rotor with a central axis co-operating with an associated distribution seat via a bearing surface that is substantially perpendicular to said axis, said rotor presenting a plurality of axial bores slidably receiving corresponding pistons, the pump being remarkable in that a driver separate from the rotor is provided to rotate about an axis of rotation that essentially coincides with said central axis, said driver serving firstly to center and rotate the rotor about said axis of rotation, and secondly to apply resilient thrust to press the bearing surface of the rotor against the distribution seat.

By being disunited from the driver in this way, the rotor is free during rotation to move axially and angularly under the effect of the spring to compensate for alignment defects between its own bearing face and the distribution seat. Furthermore, the thrust force of the spring is taken up by the driver, thereby avoiding stressing any other part of the pump. In addition, the spring is installed between two parts that move very little relative to each other, thus avoiding any sliding friction between the spring and either of those parts.

According to an advantageous characteristic, the driver receives the rotor in a hollow portion, a bearing surface formed inside the driver centering the rotor on the axis of rotation, while leaving the rotor free to slide axially relative to the driver.

Advantageously, the bearing surface is situated axially substantially halfway along the rotor.

As a result, the parasitic radial forces due to the pistons are countered substantially where they are introduced.

Preferably, the centering leaves the rotor with a certain amount of freedom to move angularly relative to the driver.

This leaves the rotor free to move angularly so as to remain continuously well pressed against the distribution seat.

According to another advantageous characteristic, the rotor and the driver are linked in rotation by corresponding mechanical means of complementary shapes carried by said rotor and driver. This can be provided by co-operation between two symmetrical lugs formed on one of the elements and complementary cavities formed in the other element, or in a variant by co-operation between fluting formed on one of the elements at the bearing surface and complementary fluting formed on the other element.

The rotary drive imparted in this way puts pure torque on the rotor, thereby leaving the rotor free to move relative to the driver.

Also advantageously, the driver has a transverse wall substantially perpendicular to its axis of rotation, with resilient means compressed against an inside face thereof to thrust the rotor against the distribution seat.

This wall thus counters the force of the resilient means and transmits it to the pump body via the rotary connection between the driver to the body (which connection can be provided for example by means of roller bearings), without this force stressing other portions of the pump, or creating interfering friction.

In an important embodiment in which the axial pistons are hinged to a rotary swashplate whose axis of rotation intersects the axis of the driver, the swashplate is advantageously constrained to rotate with the driver, preferably by means of bevel gearing.

In which case, the parasitic force introduced by contact between the teeth of the bevel gearing in addition to the driving torque is filtered by the driver, thus sparing the rotor. Furthermore, the movements of the rotor do not disturb meshing conditions.

Advantageously, the swashplate is constrained to rotate with the drive shaft of the pump.

In a particular disposition, for a pump in which the axial pistons are hinged to the swashplate by means of links having spherical ends, the swashplate receives the ends of the links in associated shaped sockets which are held to the swashplate by means of a common circular coupling plate, itself connected to the swashplate by means of a central bolt.

BRIEF DESCRIPTION OF THE DRAWINGS

Other characteristics and advantages will appear more clearly on reading the following description of the accompanying drawings, in which.

MORE DETAILED DESCRIPTION

Figure 1:
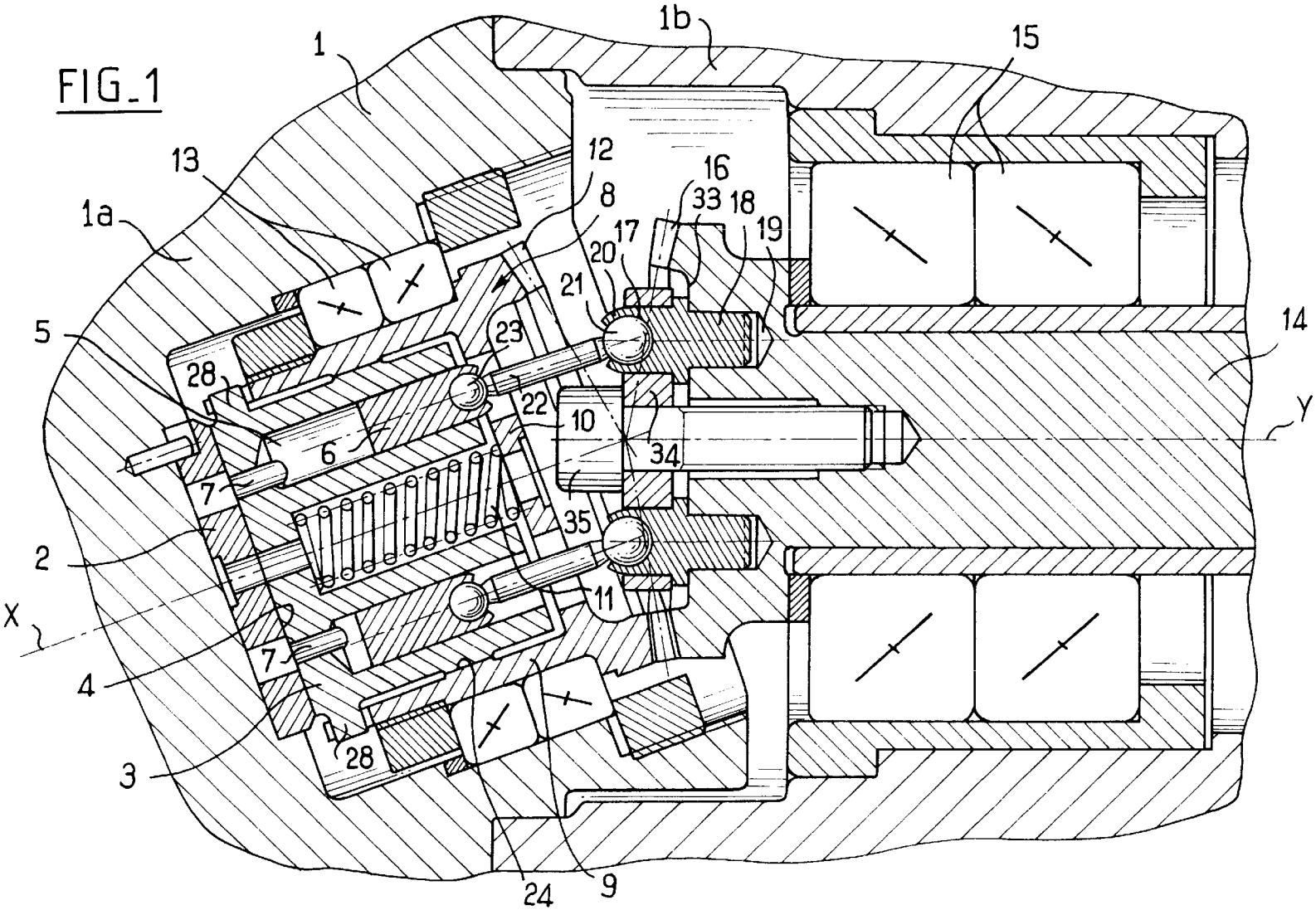
FIG. 1 is a longitudinal section through a hydraulic pump of the invention.

With reference to FIG. 1, a pump of the invention comprises a pump body 1 made up of two portions 1*a* and 1*b* that receive the component elements of the pump. The portion 1*a* receives a distribution seat 2 which co-operates with a rotor 3 via a bearing face referenced 4 that extends perpendicularly to the axis of revolution X of the rotor 3. The rotor 3 carries a series of axial bores 5 (i.e. bores extending parallel to the axis of revolution or central axis X) that are open-ended and designed to act as guides for pistons 6. A duct 7 puts the face 4 into communication with the inside volume of each cylindrical space defined by a bore 5 and the associated piston 6. Oil is admitted into the cylindrical spaces and delivered therefrom via these ducts 7.

Surrounding the rotor 3 there is mounted a rotary driver 8 comprising a cylindrical portion 9 that receives the rotor 3, a transverse wall 10 forming an end wall that serves as a bearing surface for a spring 11 serving to press the rotor 3 against the distribution seat 2, and a bevel gear 12. In this case, the driver 8 is made in the form of a single piece, but in a variant it is possible to provide for the transverse wall 10 to be a separate piece. Under such circumstances, an axial abutment should be provided, either as a separate piece (e.g. a ring) or as an integral piece (e.g. a shoulder) in order to lock the transverse wall 10 axially in position, with said locking being maintained permanently by the action of the spring 11. The driver 11 is mounted to rotate in the portion 1*a* of the body 1 via rolling bearings 13 with sloping bearing surfaces so as to allow the driver to rotate about an axis that coincides substantially with the central axis X of the rotor 3 while preventing it from moving axially. These rolling bearings 13 transmit the force from the spring 11 to the portion 1*a* of the body 1.

The driver 8 thus comprises the cylindrical portion 9 which receives the rotor 3 therein, and it is provided with the transverse wall 10 which forms a bearing surface for the spring 11, which wall is either formed integrally with said cylindrical wall 9 or else is fitted thereto.

The rotor 3 is centered on the axis of rotation of the driver 8 by an inside bearing surface 24 of the driver 8 which bears against a bearing surface of complementary shape formed on the rotor 3. The short axial length of this bearing surface and the circumferential clearance in the installed configuration preferably allow the rotor 3 to move angularly relative to the driver 8 to an extent that is small, but nevertheless sufficient to enable the rotor to float so that it can be kept permanently close against the distribution seat by the spring 11.

Furthermore, the driver 8 and its bevel gear 12 and designed to co-operate with a matching gear 16 mounted on a drive shaft 14, itself extending along an axis Y that intersects the axis X and rotatably mounted to the portion 16 of the body by means of rolling bearings 15 with sloping bearing surfaces. The shaft 14 thus has a bevel gear 16 at its end meshing with the bevel gear 12 of the driver. On the end face of the shaft 14 forming a swashplate 33 facing the driver 8 there are axially-fitted pegs 17 each having a cylindrical portion 18 received in an associated bore 19 formed in the end face of the shaft 14, and each having a spherical socket 20 for forming a ball-and-socket joint with the spherical end 21 of an associated link 22 whose other end 23 is also spherical and forms a ball-and-socket joint with the corresponding piston 6. Each bore 19 lies substantially in register with the intersection of the axis of the corresponding piston 6 and a plane normal to the axis Y and containing the centers of the sockets 20 of the pegs 17. The pegs 17 are secured to the swashplate 33 by a circular coupling plate 34 which is common to all of the pegs and which is secured by means of a central bolt 35.

The links 22 pass through the transverse wall 10 by means of openings formed through said wall 10. One opening could be provided for each link 32, or in a variant, openings could be provided that are each common to a plurality of links 22. If the end wall is fitted as a separate piece onto the driver 8, care must be taken to ensure that said wall cannot move angularly relative to the driver 8 so as to ensure that said wall 10 does not turn relative to the driver 8 and strike the links 22.

Since the central portion of the end swashplate 33 no longer needs to bear against the spring 11 as is known in the prior art, advantage can be taken of it to receive a bolt 35 for holding the pegs 17 in place, and to connect the pegs 17 to the end swashplate 33 in a manner that is very simple and the same regardless of the number of pegs that are provided.

This type of linking makes it possible to avoid associating the diameter on which the pegs 17 are distributed around the end swashplate 33 with the diameter of the shaft 14 at its bearings.

Figure 2:
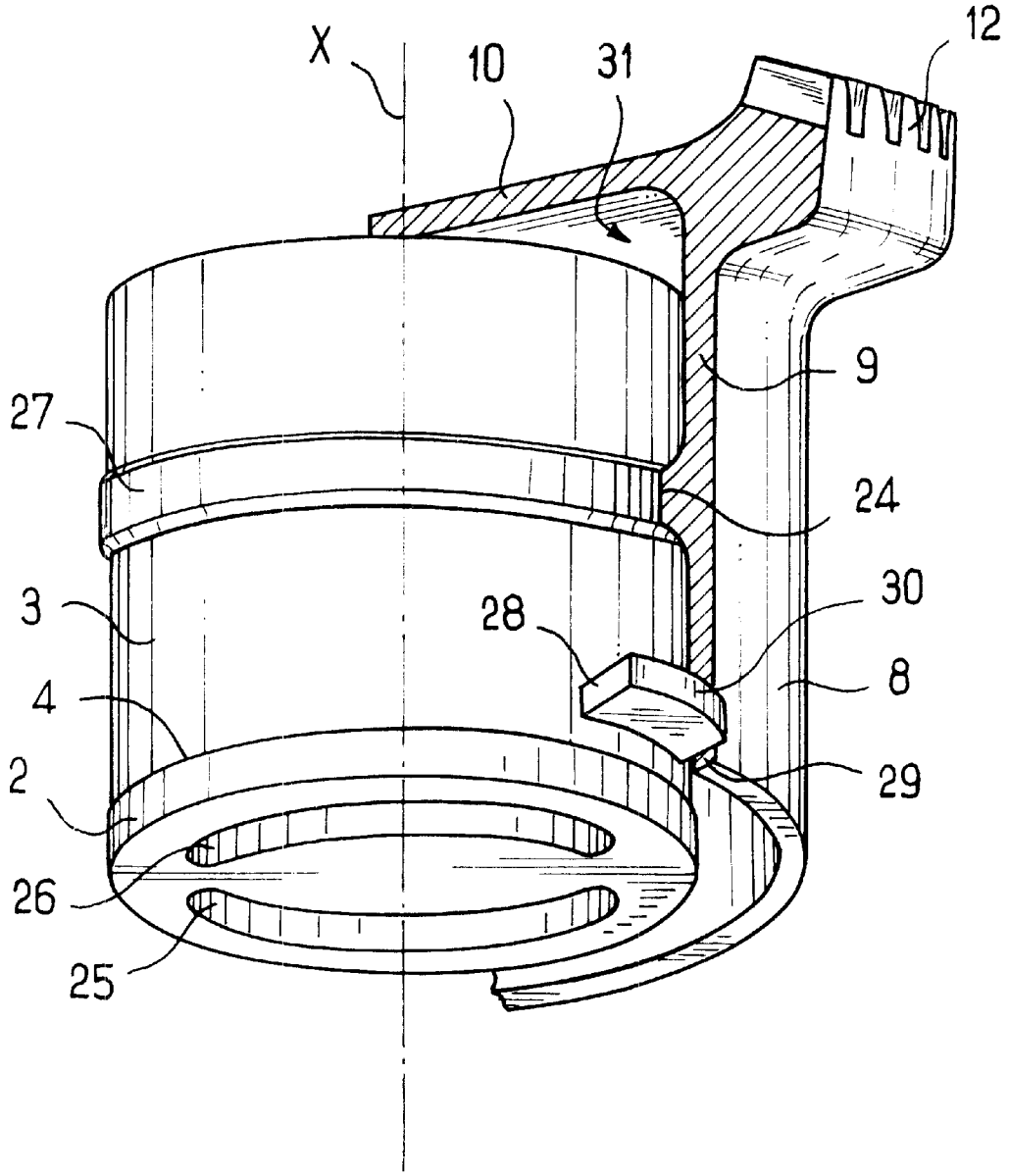
FIG. 2 is a fragmentary exploded perspective view showing how the rotor is arranged in association with the distribution seat and the driver in a pump of the invention.

In FIG. 2, there can be seen the rotor 3 bearing against the distribution seat 2 which has two through flow orifices 25 and 26 that are kidney-shaped and that serve to put the bores 5 in the rotor 3 into communication either with the delivery port or with the suction port of the pump.

The driver 8 is shown partially in section so as to reveal the cylindrical bearing surface 24 on the inside of the driver 8 which co-operates with a corresponding bearing surface 27 on the rotor 3 and situated substantially halfway along its axial length. The axial length of the bearing surface is short so that with the operating clearance that is left between these two parts, the rotor 3 is left floating to a small extent relative to the driver 8, thereby enabling the rotor 3 to be urged permanently against the distribution seat 2, even if the bearing face 4 of the rotor 3 or the distribution seat 2 is not exactly perpendicular to the axis of rotation X of the driver 8.

While the pump is in operation, the links 22 are not always exactly in alignment with the axes of the pistons 6. This gives rise to parasitic forces normal to the axes of the pistons 6, and the resultant thereof passes substantially via a midplane normal to the axis X of the rotor 3. By providing the bearing surfaces at this level, it is ensured that these forces do not generate parasitic torque tending to tilt the rotor 3 relative to the driver 8.

Furthermore, a lug 28 on the rotor 3 is mounted to co-operate with the flank 29 of a notch 30 made in the cylindrical wall 9 of the driver 8 so as to ensure that the rotor 3 is rotated by the driver 8. In this example, a symmetrical arrangement is provided so that the driver 8 rotates the rotor 3 by applying pure torque thereto. Naturally, in a variant, the lugs 28 could be secured to the driver 8 and the notches 30 could be formed in the rotor, or indeed any other arrangement could be implemented using corresponding mechanical means with complementary shapes, for example fluting in register with the bearing surface 26 provided on one of the driver and the rotor, and co-operating with complementary fluting provided on the other one of them (variant not shown herein).

The invention is not limited to the particular embodiment described above, but on the contrary covers any variant using equivalent means to reproduce the essential characteristics specified herein.

In particular, the driver 8 could be connected to the drive shaft of the pump, in which case the swashplate 33 would be driven by the driver 8.

Furthermore, the swashplate 33 could be constrained to rotate with the driver 8 using some other type of coupling, for example a universal joint, a friction coupling, etc.

Finally, separating the driver 8 from the rotor 3 is equally applicable to pumps having in-line axial pistons where the swashplate 33 does not rotate, and in which shoes at the ends of the axial pistons 6 slide over the swashplate, or indeed pumps with axial pistons in-line having rotor capacity that is variable by tilting the axis of rotation of the swashplate relative to the axis of the rotor, or by tilting the swashplate itself.

What is claimed is:

1. A hydraulic pump having axial pistons, the pump being of the type having intersecting axes, and comprising a rotary rotor with a central axis co-operating with an associated distribution seat via a first bearing surface that is substantially perpendicular to said axis said rotor presenting a plurality of axial bores slidably receiving corresponding pistons, wherein a driver separate from the rotor is provided to rotate about an axis of rotation that essentially coincides with said central axis, said driver serving to center and rotate the rotor about said axis of rotation, and having a biasing member to apply resilient thrust to press the first bearing surface of the rotor against the distribution seat.

2. A pump according to claim 1, wherein the driver receives the rotor in a hollow portion, and wherein a second bearing surface formed inside the driver centers the rotor on the axis of rotation, while leaving the rotor free to slide axially relative to the driver.

3. A pump according to claim 1, wherein a second bearing surface is situated axially substantially halfway along the rotor.

4. A pump according to claim 1, wherein the centering leaves the rotor with a certain amount of freedom to move angularly relative to the driver.

5. A pump according to claim 1, wherein the rotor and the driver are linked in rotation by corresponding mechanical means of complementary shapes carried by said rotor and driver.

6. A pump according to claim 5, wherein the rotary link between the rotor and the driver is provided by co-operation between two symmetrical lugs provided on one of said elements and complementary cavities formed in the other element.

7. A pump according to claim 5, wherein the rotary link between the rotor and the driver is provided by co-operation of fluting formed on one of the elements at a third bearing surface with complementary fluting formed on the other element.

8. A pump according to claim 1, wherein the driver has a transverse wall substantially perpendicular to its axis of rotation, with resilient means compressed against an inside face thereof to thrust the rotor against the distribution seat.

9. A pump according to claim 1, in which the axial pistons are hinged to a rotary swashplate whose axis of rotation intersects the axis of the driver, wherein the swashplate is coupled to rotate with the driver.

10. A pump according to claim 9, in which the rotary coupling is provided by means of bevel gearing.

11. A pump according to claim 9, wherein the swashplate is constrained to rotate with the driver of said pump.

12. A pump according to claim 9, in which the axial pistons are hinged to the swashplate by means of links having spherical ends, wherein the swashplate receives the ends of the links in associated shaped sockets which are held to the swashplate by means of a common coupling plate connected to the swashplate by means of a central bolt.

13. A hydraulic pump having axial pistons, the pump being of the type having intersecting axes, and comprising a rotary rotor with a central axis co-operating with an associated distribution seat via a first bearing surface that is substantially perpendicular to said axis, said rotor presenting a plurality of axial bores slidably receiving corresponding pistons, wherein a driver separate from the rotor is provided to rotate about an axis of rotation that essentially coincides with said central axis, said driver comprising:

means for centering and rotating the rotor about said axis of rotation, and means for applying resilient thrust to press the first bearing surface of the rotor against the distribution seat.

* * * * *